United States Patent [19]

Carpman

[11] 4,098,383

[45] Jul. 4, 1978

[54] METHOD FOR THE FEED OF CYLINDRICAL OBJECTS TO A WORKING MACHINE

[76] Inventor: Leif Carpman, Askelyckevagen 17, 544 00 Hjo, Sweden

[21] Appl. No.: 780,786

[22] Filed: Mar. 24, 1977

[51] Int. Cl.[2] ..... B65G 1/02; B65H 1/06

[52] U.S. Cl. ..... 193/2 R; 221/197; 221/281; 221/287; 229/7 R; 229/17 B; 312/45

[58] Field of Search ..... 193/2 R; 229/7 R, 17 B, 229/23 BT, 43, 51 D; 221/287, 281, 197, 46; 222/325; 312/45, 72

[56] References Cited

U.S. PATENT DOCUMENTS

| | | | |
|---|---|---|---|
| 1,373,161 | 3/1921 | Bliss | 229/43 |
| 1,451,963 | 4/1923 | Scruby | 229/43 |
| 1,506,084 | 8/1924 | Richmond | 229/7 R |
| 3,901,432 | 8/1975 | Lancaster | 229/23 BT |

*Primary Examiner*—Evon C. Blunk
*Assistant Examiner*—Jeffrey V. Nase

[57] ABSTRACT

Method of charging a chute for the feed of objects to a machine using a casing which has a band shaped frame forming a wall surrounding the objects and two detachable end lids closing the frame at lateral edges opposite each other. The frame at one point on its circumference is pliable apart. The method comprises removing one end lid, placing the casing in an opening in the side of the chute, and removing the other end lid. The opening in the chute is then closed and the frame is plied apart to release the objects in the chute.

1 Claim, 7 Drawing Figures

METHOD FOR THE FEED OF CYLINDRICAL OBJECTS TO A WORKING MACHINE

The present invention relates to a method for the feed of cylindrical objects as for example tubes to a working machine by way of example a tube filling machine.

It is a principal object of the invention to provide a method which permits simple handling of the objects in question intended for treatment in connection with storage as well as in connection with transportation and charging of the hopper of the machine.

This object is reached by the device according to the invention, which substantially is characterized by including or comprising a casing intended to receive a pile of said objects intended for treatment as by way of example tubes intended to be filled, said casing having a frame of band shape, which forms a wall surrounding objects enclosed in the same, said frame at least at one point counted along its circumference being pliable apart, and two detachable end lids, which close said frame at lateral edges opposite to each other.

Figure 1:
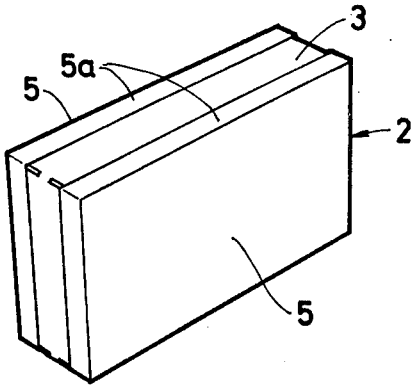
Figure 2:
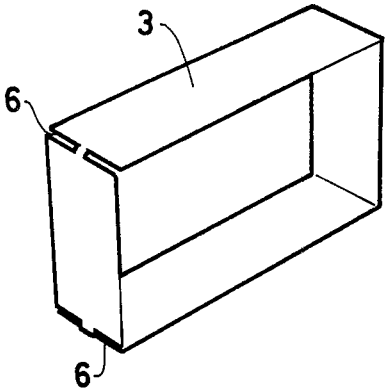
Figure 4:
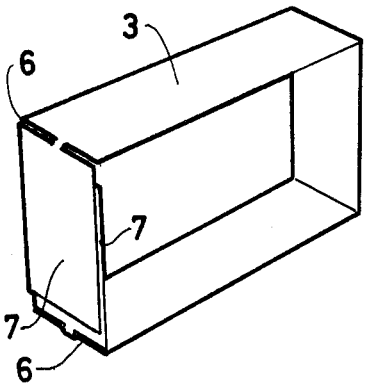
Figure 3:
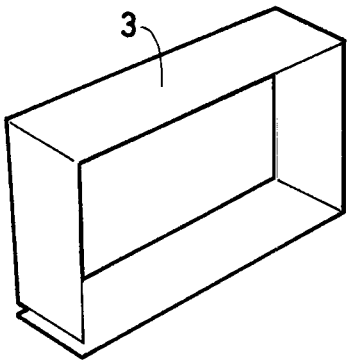
Figure 5:
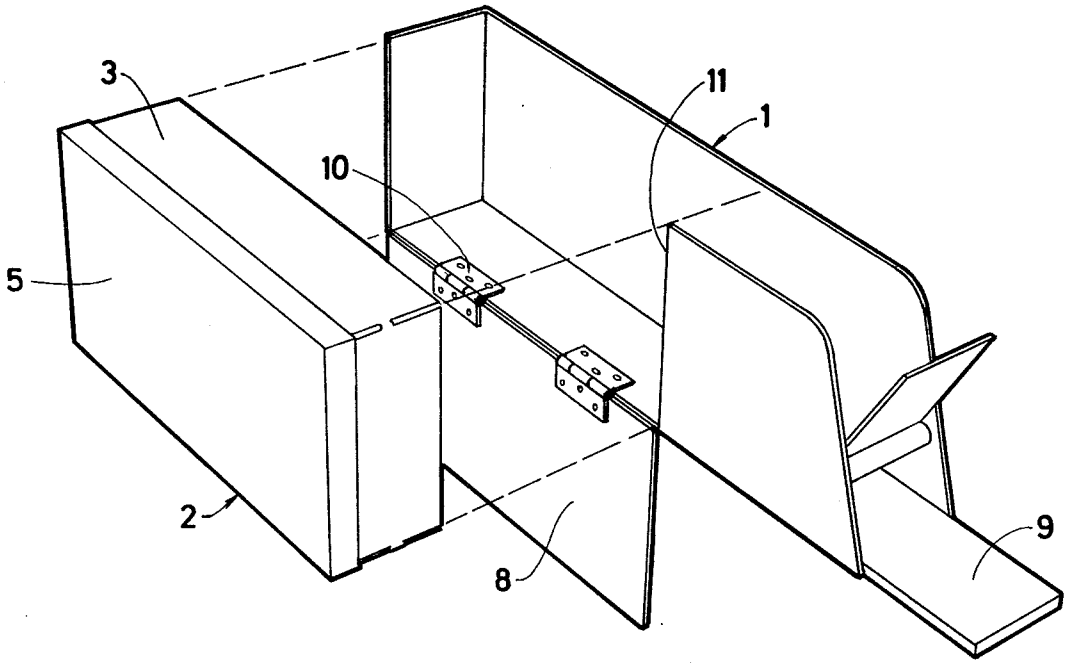
Figure 6:
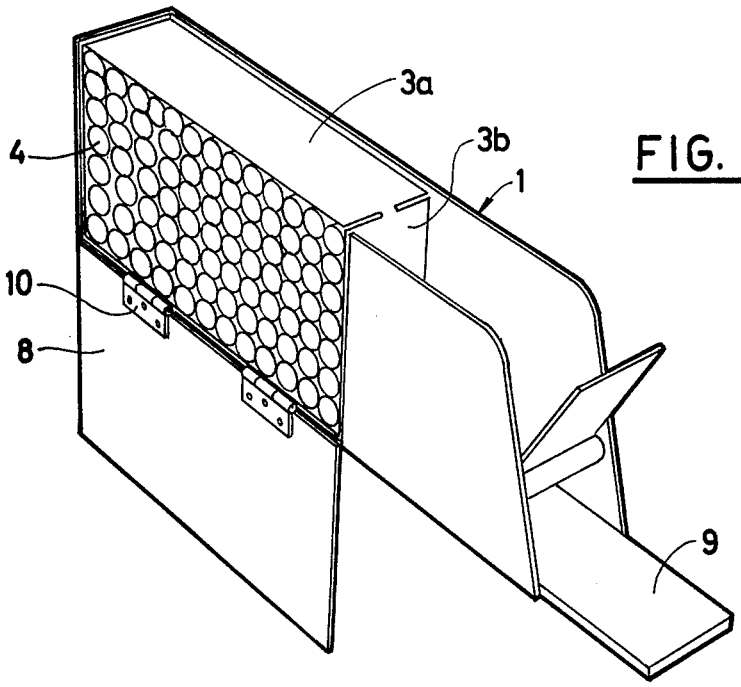
Figure 7:
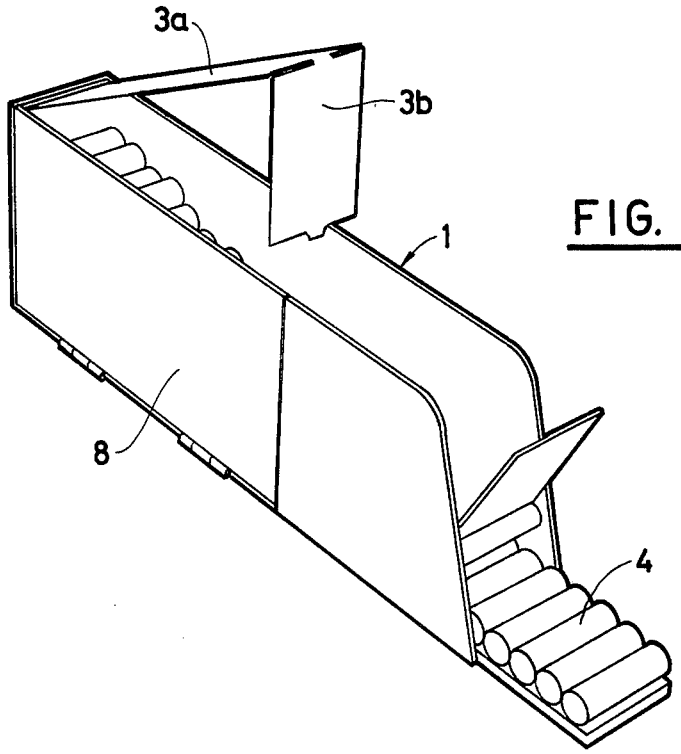

An example of embodiment of the invention is described in the following, reference being made to the accompanying drawings, in which FIG. 1 is a perspective view of a casing forming part of the device, FIG. 2 is a perspective view of a part of the casing illustrated in FIG. 1, FIG. 3 shows another embodiment of the part illustrated in FIG. 2, FIG. 4 shows the same part in still another embodiment, and the FIGS. 5–7 illustrate the charging of a working machine by means of the device according to the invention.

In the drawings a chute shaped charging member of a working machine is in its entirety indicated with 1, said machine for example being intended for filling of tubes. As this working machine does not directly concern the present invention, it has been left out of the drawings. A casing of the form of a magazine is in its entirety indicated with 2 and is intended to be used in connection with the charging chute 1. The magazine shaping the casing comprises a band shaped frame 3, the width of which is preferably greater than the length of the objects 4, for which the casing is intended. The casing further comprises end lids 5, which close the frame on lateral edges opposite to each other. The frame 3 forming part of the casing of FIG. 1 is also shown in FIG. 2. As is best evident from this figure, the frame substantially has a rectangular shape, and at the corner edges of one of its ends it is provided with open slits 6, which extend in direction towards the centre of the frame.

The casing illustrated in FIG. 3 is completely open at one of its corners, while the casing illustrated in FIG. 4 is slit open at two corners as is the case with the frame in FIG. 2, but in addition the frame according to FIG. 4 has two flaps 7, each extending from a slit corner and overlapping as shown. The frame 3 can suitably be made of flexible material, which has a comparatively good stiffness, as by way of example corrugated board. In this case it is suitable that the direction of the corrugations is arranged parallel to the edge corners of the frame. By this arrangement good possibilities of piling of the casing when stored and transported is obtained without objects kept in the same being subjected to harmful load pressure. In closed condition of the casing the frame 3 is efficiently kept in position by the flaps 5a on the end lids, which project over the same. The charging chute 1 in one of its lateral walls is provided with a lid 8, which is pivotably journaled at the bottom 9 of the chute by means of hinges 10, and at the opening up of which an opening 11 is uncovered, which has a greater extension in the longitudinal direction of the charging chute 1 than the extension of the casing 2 in the same direction. The charging of the casing with the objects in question suitably takes place with one of the end lids 5 in fitted position and with the other end lid 5 removed, whereafter the other end lid is fitted for storage and transportation. The charging chute 1, which forms the magazine for the working machine in question is charged by means of a knife or similar being inserted into the slit in the lower corner of the frame 3 and this thereafter being broken up, whereafter the right end lid 5 according to FIG. 1 is removed. Then the magazine formed by the casing is put in place in the charging chute 1 as is shown in the FIGS. 5 and 6, whereafter the other end lid is removed. The lateral lid 8 of the chute is pivoted up to the position shown in FIG. 7, whereafter the upper portion 3a of the frame 3 is lifted up together with its end 3b. The objects intended for treatment are thereby given a free passage through the outlet end of the charging chute 1 in order to be fed to the working machine in question.

It is of course within the scope of the invention to design the charging chute in such a manner that it can be opened at the other side. A casing with the frame illustrated in FIG. 2 is fit for use irrespective of the actual charging chute being intended for charge to the right or if the intended charge is intended to the left. This also is valid for a casing with a frame of the design shown in FIG. 4, which however does not require being cut up at the corner. In connection with this frame the slits only form a folding notch, which in this embodiment of course also can be a folding line. Also a casing with the frame illustrated in FIG. 3 need not to be cut up in the corner, as it is already open.

By means of the invention one has obtained a method, which makes possible a very simple handling in connection with storage and transportation as well as with the charging of the working machine, at the same time as one obtains a single-use casing of magazine type, which can be made of very cheap material as for example board.

The invention is not limited to the embodiment described above and illustrated in the drawings by way of example only, but can be varied as to its details within the scope of the following claims without departing from the fundamental idea of the invention.

I claim:

1. Method of charging a chute for the feed of objects to a machine for treatment thereby using a casing for receiving said objects and transporting them to said chute which has a lid in its side adapted to be opened and uncover an opening adapted to receive said casing in said chute, said casing having a frame of band shape forming a wall surrounding said objects and two detachable end lids closing said frame at lateral edges opposite to each other, said frame at least at one point along its circumference being pliable apart, said method comprising removing one end lid of said casing, placing the remaining casing in the opening in said chute, removing the other end lid of said casing, closing said chute lid, and plying said frame apart to release the objects in the chute.

* * * * *